US006695043B1

(12) United States Patent
Wagner et al.

(10) Patent No.: US 6,695,043 B1
(45) Date of Patent: Feb. 24, 2004

(54) FALLING-FILM EVAPORATOR AND CORRESPONDING AIR DISTILLATION PLANTS

(75) Inventors: Marc Wagner, Saint Maur des Fosses (FR); Jean-Yves Thonnelier, Voisins le Bretonneux (FR); Etienne Werlen, Versailles (FR); Jean-Renaud Brugerolle, Paris (FR); Jean-Yves Lehman, Maisons Alfort (FR)

(73) Assignee: L'Air Liquide - Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/455,900

(22) Filed: Dec. 7, 1999

(30) Foreign Application Priority Data

Dec. 7, 1998 (FR) ..... 98 15421

(51) Int. Cl.[7] ..... A23C 3/04

(52) U.S. Cl. ..... 165/115; 165/116; 165/166; 62/903

(58) Field of Search ..... 165/166, 115, 165/116, 167; 62/903

(56) References Cited

U.S. PATENT DOCUMENTS

| | | | | |
|---|---|---|---|---|
| 3,457,990 A | | 7/1969 | Theophilos | |
| 3,983,935 A | * | 10/1976 | Henrion | 165/166 |
| 4,276,927 A | * | 7/1981 | Foust | 165/166 |
| 4,599,097 A | * | 7/1986 | Petit et al. | 165/166 |
| 4,641,706 A | | 2/1987 | Haynie | |
| 4,646,822 A | * | 3/1987 | Voggenreiter et al. | 165/166 |
| 4,747,448 A | | 5/1988 | Beduz et al. | |
| 5,031,693 A | * | 7/1991 | VanDyke | 165/166 |
| 5,122,174 A | * | 6/1992 | Sunder et al. | 165/166 |
| 5,316,628 A | * | 5/1994 | Collin et al. | 165/166 |
| 5,505,256 A | * | 4/1996 | Boardman et al. | 165/166 |
| 5,667,643 A | * | 9/1997 | Satchell, Jr. et al. | 165/166 |
| 5,709,264 A | * | 1/1998 | Sweeney et al. | 165/166 |
| 5,868,199 A | * | 2/1999 | Lavin | 165/166 |

FOREIGN PATENT DOCUMENTS

WO WO 94 27106 11/1994

* cited by examiner

*Primary Examiner*—Christopher Atkinson
(74) *Attorney, Agent, or Firm*—Young & Thompson

(57) ABSTRACT

An evaporator has main passages placed in a heat-exchange relationship, an arrangement for forming a pool of the liquid to be evaporated so that it flows through at least a first of the main passages, and a device for introducing a refrigerant into at least a second of the main passages so that evaporation of the liquid is ensured. The or each first main passage possesses, in the free section transverse to the direction of flow of the liquid to be evaporated, at least one continuous free-flow region sufficiently extended to allow the liquid to get round a deposit of impurities, or, the main passages being bounded by vertical plates having a substantially similar contour and being parallel and spaced apart so as to form the flat main passages, at least one first main passage is either narrower than the corrugation nor an auxiliary passage, or contains one or more closed auxiliary passages which extend over most of the length of the heat exchanger body parallel to the direction of flow of the liquid to be evaporated, the walls of the auxiliary passage(s) touching the plates defining the main passage.

26 Claims, 5 Drawing Sheets

FALLING-FILM EVAPORATOR AND CORRESPONDING AIR DISTILLATION PLANTS

BACKGROUND OF THE INVENTION

1. Field of the Invention

The present invention relates to an evaporator of the type comprising a heat-exchanger body which has main passages placed in a heat-exchange relationship, means for forming a pool of the liquid to be evaporated so that it flows through at least a first of said main passages, and means for introducing a refrigerant into at least a second of said main passages so that evaporation of the liquid is ensured.

The invention applies, for example, to a reboiler-condenser for a double-column air distillation plant.

In such a reboiler-condenser, oxygen-rich liquid coming from the bottom of the low-pressure column is evaporated in the reboiler-condenser by condensing a nitrogen-rich gas withdrawn from the top of the medium-pressure column.

More generally, an air separation apparatus such as a double distillation column comprises several types of heat exchanger.

2. Description of the Prior Art

A main heat exchanger serves to cool the feed air for the apparatus to the distillation temperature by heat exchange with one or more fluids coming from the distillation apparatus. In some cases, these are pressurized liquids from the apparatus which vaporize against the air to be distilled in the exchanger. These exchangers are normally made entirely of aluminum or copper or alloys of these metals (WO 95/28610).

For safety reasons, these liquids sometimes vaporize in a dedicated exchanger, or evaporator, against a single fluid such as air or nitrogen.

The apparatus also comprises at least one reboiler-condenser which is a heat exchanger placed inside or outside the column. These reboiler-condensers are usually made entirely of copper, stainless steel, nickel or aluminum and consist of at least two circuits which are connected to the rest of the plant by means of pipes welded to the equipment.

The exchangers used in air separation apparatuses comprise heat exchanger bodies which are often produced in the form of parallel aluminum plates having a similar contour and being brazed together.

In general in exchangers which serve as evaporators, an oxygen-rich liquid is vaporized as it flows a countercurrent with respect to a nitrogen-rich gas (such as air or nitrogen with a purity greater than 80%).

In order to improve the performance of these evaporators, it is possible to use evaporators called "trickling-film or falling-film evaporators", that is to say of the aforementioned type, and in which the oxygen-rich liquid of the pool is delivered at the top of the evaporator in the form of a very thin film which flows vertically through the first main passages and part of which is vaporized by heat exchange with the passages dedicated to the nitrogen-rich gas in a cocurrent manner.

EP-0,795,349 describes the case in which such an evaporator is combined with a thermosiphon-type evaporator (a so-called pool evaporator, that is to say an evaporator completely immersed in the liquid where the recirculation of the oxygen-rich liquid takes place by virtue of the hydraulic thrust due to the difference in density between the pool and the liquid being vaporized in the passages).

In the brazed-plate exchanger bodies used in evaporators of the aforementioned falling-film type, such as that in EP-A-0,130,122, the liquid is distributed between many passages consisting of vertical corrugations inserted between two sheets called separating sheets and thus constituting heat fins and, because of the pitch of these corrugations, the brazed-plate heat exchanger bodies have exchange surfaces of very large area.

Therefore, when the entire surface is wetted, the liquid film will be very thin and to avoid dry evaporation in the bottom of the first main passages or should there be a distribution defect, excess liquid is made to flow through the heat exchanger body. This excess liquid generally requires liquid to be recycled by means of a pump.

In evaporators of the aforementioned type, called pool evaporators, recirculation of the liquid is also maintained in order to prevent dry evaporation at the top of the first main passages.

Moreover, U.S. Pat. No. 5,699,671 describes an evaporator having a tube-type exchanger body, arranged vertically, in which the gaseous nitrogen condenses in contact with its tubes.

It has been found, especially in falling-film reboiler-condensers, that solid contaminants such as, for example, hydrocarbons or nitrogen protoxide, may accumulate in the passages dedicated to the oxygen-rich fluid, and this can lead to the blockage of these passages.

Such a blockage therefore degrades the operation of the reboiler-condenser.

One object of the invention is to solve this problem by providing an evaporator of the aforementioned type which reduces the risk of blockage of the passage or passages dedicated to the liquid to be evaporated.

Another object of the invention is to minimize the recirculation of the liquid to be evaporated in evaporators of the aforementioned type and to ensure operating safety and optimum performance.

For this purpose, the subject of the invention is an evaporator of the aforementioned type, wherein the or each first main passage possesses, in the free section transverse to the direction of flow of the liquid to be evaporated, at least one continuous free-flow region sufficiently extended to allow the liquid to get round a deposit of impurities, or, when the main passages are bounded by vertical plates having a substantially similar contour and being parallel to one another and spaced apart so as to form the flat main passages, at least a first main passage is either narrower than the second main passage and contains neither an exchange corrugation nor an auxiliary passage, or contains one or more closed auxiliary passages which extend over most of the length of the heat-exchanger body parallel to the direction of flow of the liquid to be evaporated, the walls of the auxiliary passage(s) touching the plates defining the main passage.

Preferably, all the first main passages contain at least one closed auxiliary passage.

Thus, the liquid sent into the auxiliary passage passes through the evaporator without contacting the plates defining the first main passages. As far as possible, the liquid must be prevented from flowing between the outside of the auxiliary passage and the passages defined by the plates.

One means of avoiding this problem consists in forming the auxiliary passages in a block of material (for example made of aluminum, nickel or copper). If the block has substantially dimensions of a first main passage, the liquid cannot flow outside the auxiliary passages, which are all cylindrical holes passing through the block.

Ideally, the maximum width of an auxiliary passage is greater than 50% of the distance between two adjacent plates.

In order to prevent the accumulation of impurities, the internal surface of the auxiliary passage or of each auxiliary passage comprises only curved surfaces and, possibly, convexities. The absence of cavities in the passages of the first set ("liquid" passages) has never been proposed in the prior art.

According to one embodiment, at least one, and preferably all, of the first main passages contain several auxiliary passages consisting of a series of cylindrical tubes parallel to one another and each having a diameter at least equal to 50% of the separation between two adjacent plates.

According to another embodiment, at least one and preferably all of the first main passages contain several auxiliary passages consisting of tubes, each having an internal surface with at least three identical convexities and curved surfaces connecting the convexities.

The adjacent tubes may or may not be contiguous.

Preferably, there are means for directing liquid into the or each auxiliary passage and/or liquid distribution means consisting of predistribution openings, these openings allowing this liquid to fall over a packing located above the means for directing liquid into one or each auxiliary passage.

In one embodiment, the means for directing the liquid into the passages are inclined tips, the ends of which lie above the inside of the auxiliary passage (or of an auxiliary passage).

The evaporator may be a main exchanger which serves to cool purified air to its distillation temperature, a subcooler or the reboiler-condenser of a double column.

The subject of the invention is also an air distillation plant comprising at least one evaporator as defined above.

BRIEF DESCRIPTION OF THE DRAWINGS

The invention will be more clearly understood on reading the description which follows, given solely by way of example, and with reference to the appended drawings in which.

DETAILED DESCRIPTION OF THE PREFERRED EMBODIMENTS

Figure 1:
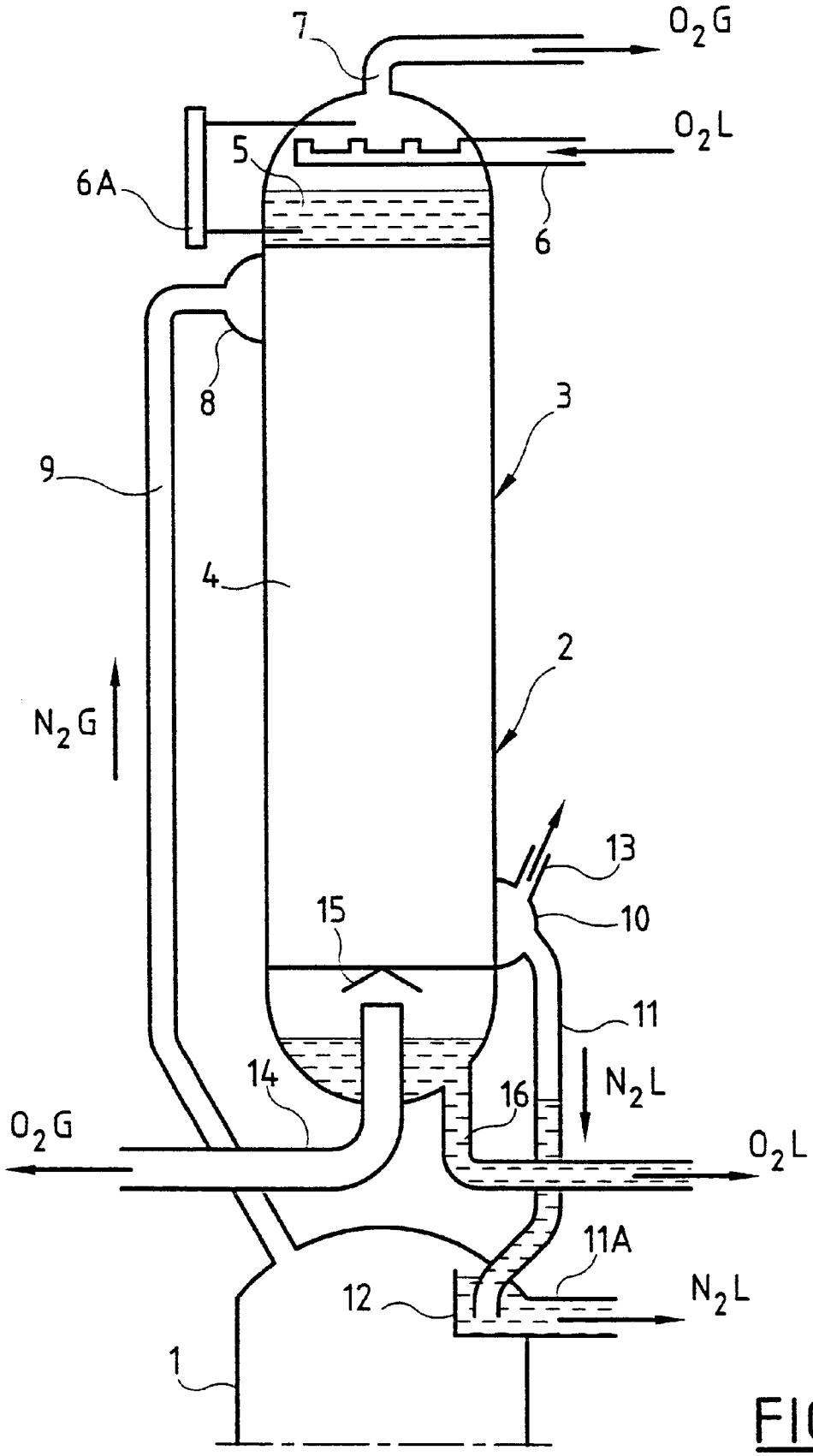
FIG. 1 is a partial diagram of an air distillation plant according to the invention.
Figure 2:
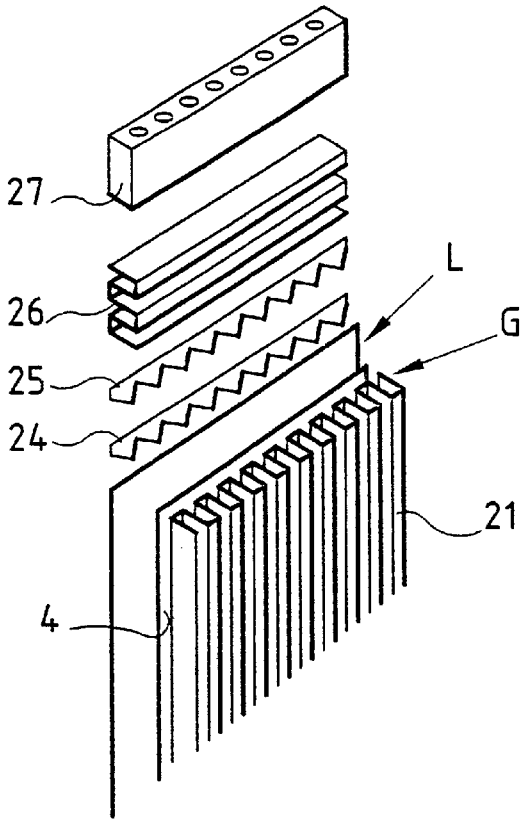
FIG. 2 is an exploded schematic view of the reboiler-condenser of the plant in FIG. 1.
Figure 3:
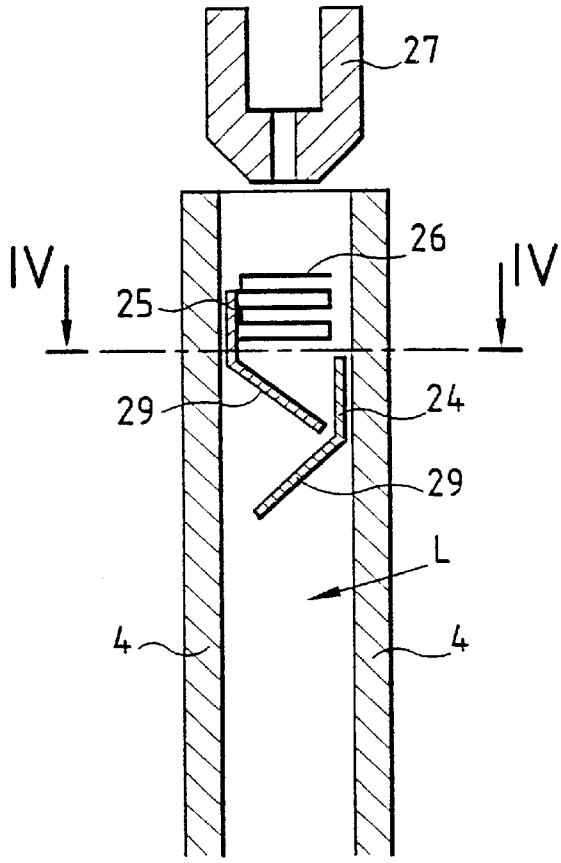
FIG. 3 is a partial, schematic and sectional view of a passage of the reboiler-condenser of FIG. 1, dedicated to the circulation of the liquid to be evaporated.
Figure 4:
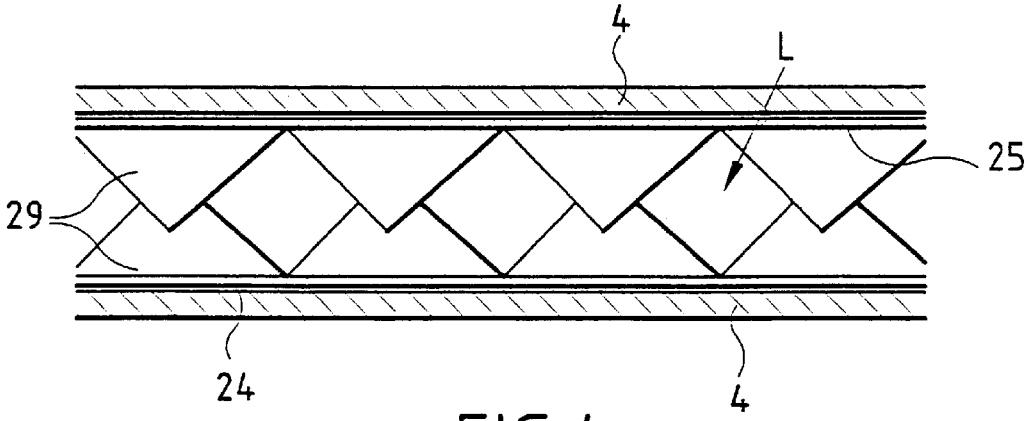
FIG. 4 is a partial, schematic and sectional view taken on the line IV—IV of FIG. 3.

FIG. 1 illustrates a reboiler-condenser 2 (see the description of FIG. 1 in EP-A-0,130,122). The reboiler-condenser 2 comprises a heat-exchanger body formed by a fluidtight vessel 3 and a series of parallel vertical plates 4 made of aluminum, which define a multitude of main flat passages intended alternately for one of two fluid streams, for example a gas stream containing 98% nitrogen at approximately 5 bar, and a liquid stream containing 98% oxygen at approximately 1.5 bar. Obviously, the pressures and the purities may take other values.

The passages dedicated to the liquid to be vaporized are called first main passages and are identified by the letter L in the figures, while the passages dedicated to the gas to be condensed are called second main passages and are identified by the letter G in the figures.

The space lying above the plates 4 contains a pool 5 of the liquid to be vaporized coming from a pipe 6.

As illustrated in FIGS. 1 to 4, the liquid of this pool enters each first passage L through a series of perforations in an upper distribution bar 27. It then falls onto a corrugation 26 which is an unperforated aluminum sheet having horizontal generatrices (an arrangement called a hardway in relation to the liquid oxygen flow) and with a partial vertical offset (the partial vertical offset is not illustrated in order not to clutter up the figures) and which ensures fine distribution of the liquid.

The liquid falls from the corrugation 26 onto an upper drip 25 consisting of a folded aluminum strip with a series of triangular tips 29 making an angle of 135° with the plane of one of the plates 4 of the passage L in question.

The end of each tip 29 of the upper drip 25 lies above a tip of a lower drip 24, which is identical to the first drip but the tips of which are oriented toward the other plate 4 of passage L in question.

The liquid to be vaporized then flows over the plates 4 of the first passage L in question, in the form of a downward falling film.

The gas to be condensed enters the second passages G by means of a pipe 9 welded to the middle of a semicylindrical head 8 (sometimes called a "box" or a "headline").

The gas then flows downward in the second passages G as a cocurrent with the liquid in the first passages L, the condensing of the gas causing the liquid to vaporize in the first passages L.

Figure 5A:
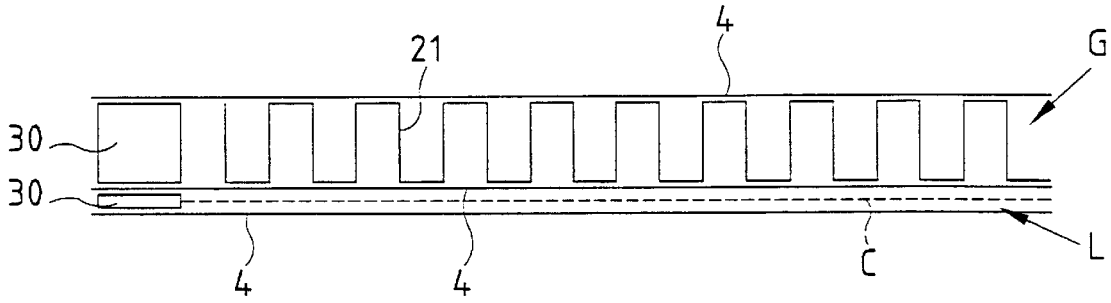
FIG. 5*a* is a schematic partial section illustrating the structure of the passages of the reboiler-condenser of FIG. 1, these being dedicated to the liquid to be vaporized and to the gas to be condensed.

As illustrated in FIG. 5*a*, only the second passages G each contain a spacer corrugation 21 consisting of a corrugated perforated aluminum sheet having vertical generatrices (an "easy-way" arrangement).

Conventionally, these spacer corrugations 21 also fulfill the function of heat fins.

The first passages L have a thickness of less than that of the second passages G.

In particular, the thickness of the first passages L is between 2.5 mm and two-thirds of the thickness of the second passages G.

The first passages L are each bounded by two adjacent plates 4 and by closure bars 30 located between them along their lateral edges. The plates 4, between which a first passage L is located, therefore define between them a free and continuous space virtually over their entire width, this width being measured in a direction transverse to that of the flow of the falling film.

The first passages L are narrower than the second passages G and contain neither exchange corrugations nor auxiliary passages. The distance between the adjacent plates 4 of the first passages L varies between 2.5 mm and two-thirds of the separation between the plates 4 of the second passages G.

Consequently, the first passages L possess, over their entire length, a continuous rectangular cross section free of any obstacle. This section has a width approximately equal to the width of the plates 4 and therefore equal to the width of the heat exchanger body, that is to say a width of approximately 1 meter.

Because of the transverse extent of the passages L, the risk of the latter blocking is therefore limited.

This is because, if a local deposit of substances resulting from the vaporization of the liquid is produced on the plates 4 of a first passage L, the liquid to be vaporized can get round this deposit.

In addition, it is found that the structure of the first passages L makes it possible to limit the necessary liquid recirculation in the evaporator 2.

In general, the risk of blocking may be limited by using first passages L having a free cross section, that is to say a continuous flow region free of any obstacle, which extends along a director curve C of length greater than approximately 10 cm. In the case of FIGS. 1 to 5*a*, this director curve C is a straight line parallel to the plates 4, lying between the latter, and having a length of approximately 1 m. The straight line C is shown dotted in FIG. 5*a*.

Figure 5B:
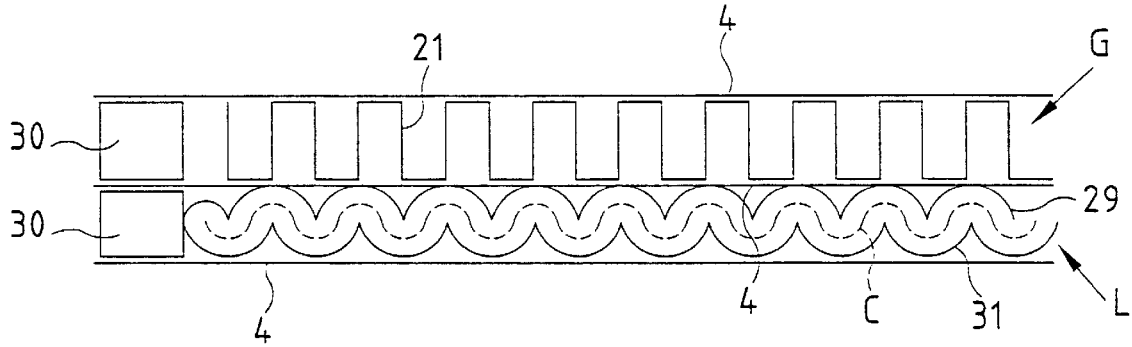
FIGS. 5*b* to 5*d* are views similar to FIG. 5*a*, illustrating embodiments of the invention.

According to the embodiment in FIG. 5*b*, the distance separating the two plates 4 associated with a first passage L is greater than that of the embodiment in FIGS. 1 to 5*a*.

Two identical sheets 29 and 31, made of aluminum, and having a cross section in the form of an epicycloid, are arranged between the two plates 4 associated with each first passage L and extend over their entire length. Each sheet 29, 31 therefore comprises a series of semicylindrical sections joined to the ends so as to form a curved line.

Each sheet 29, 31 is supported by a plate 4. The concavities of the sheets 29, 31 are directed toward each other. The sheets 29 and 31 are offset transversely with respect to each other so that the tips of each sheet are located opposite a hollow of the other sheet. Thus, the two sheets 29 and 31 form a single auxiliary passage between them, through which passage all of the fluid circulating in the first passage L in question flows.

The sheets 29 and 31 act as heat fins and therefore define between them the flow region for the liquid to be vaporized.

The auxiliary passage of each first passage L extends, in its cross section, continuously and freely virtually over the entire width of the heat exchanger body. The abovementioned director curve C then extends between the sheets 29 and 31, following their contours. The director curve is therefore sinuous and has a length greater than 1 m.

Here also, the first passages L reduce the risk of blockage by virtue of a transverse extent sufficient for the liquid to be vaporized to get round any deposits.

Figure 5C:
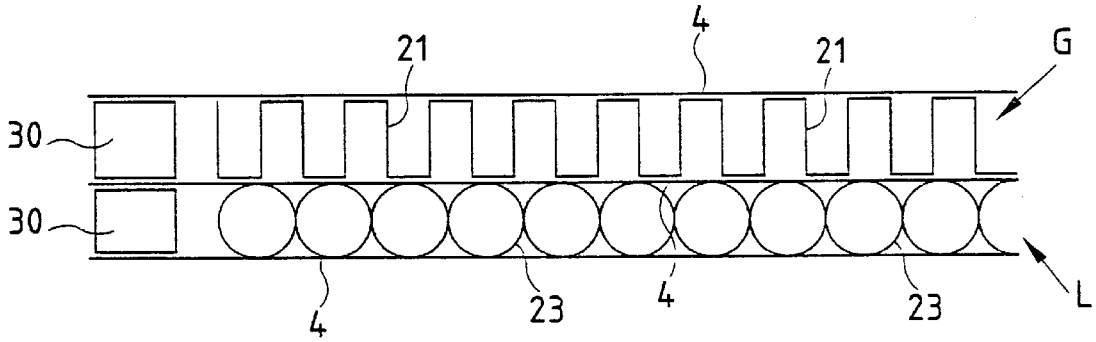

In the embodiment in FIG. 5*c*, the auxiliary passages of the first passages L are formed by contiguous tubes 23 made of aluminum. Lying in the second passages G are the corrugations 21 having conventional vertical generatrices.

Figure 5D:
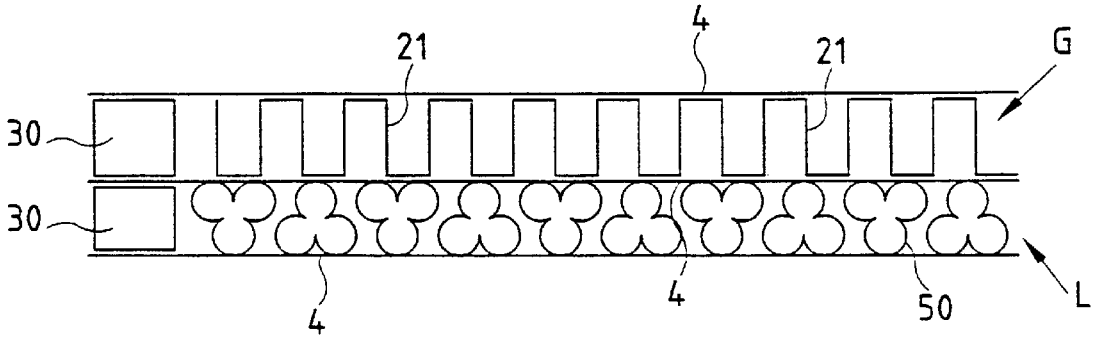

In the embodiment in FIG. 5*d*, the auxiliary passages of the first passages L are noncontiguous tubes having a clover leaf-shaped section.

In each case in FIGS. 5*b* to 5*d*, the auxiliary passage(s) only comprises curved surfaces or convexities, thus preventing the accumulation of impurities in the passages and allowing the necessary liquid recirculation in the evaporator 2 to be limited.

The invention is not limited to falling-film evaporators but applies also to so-called pool evaporators.

Figure 6:
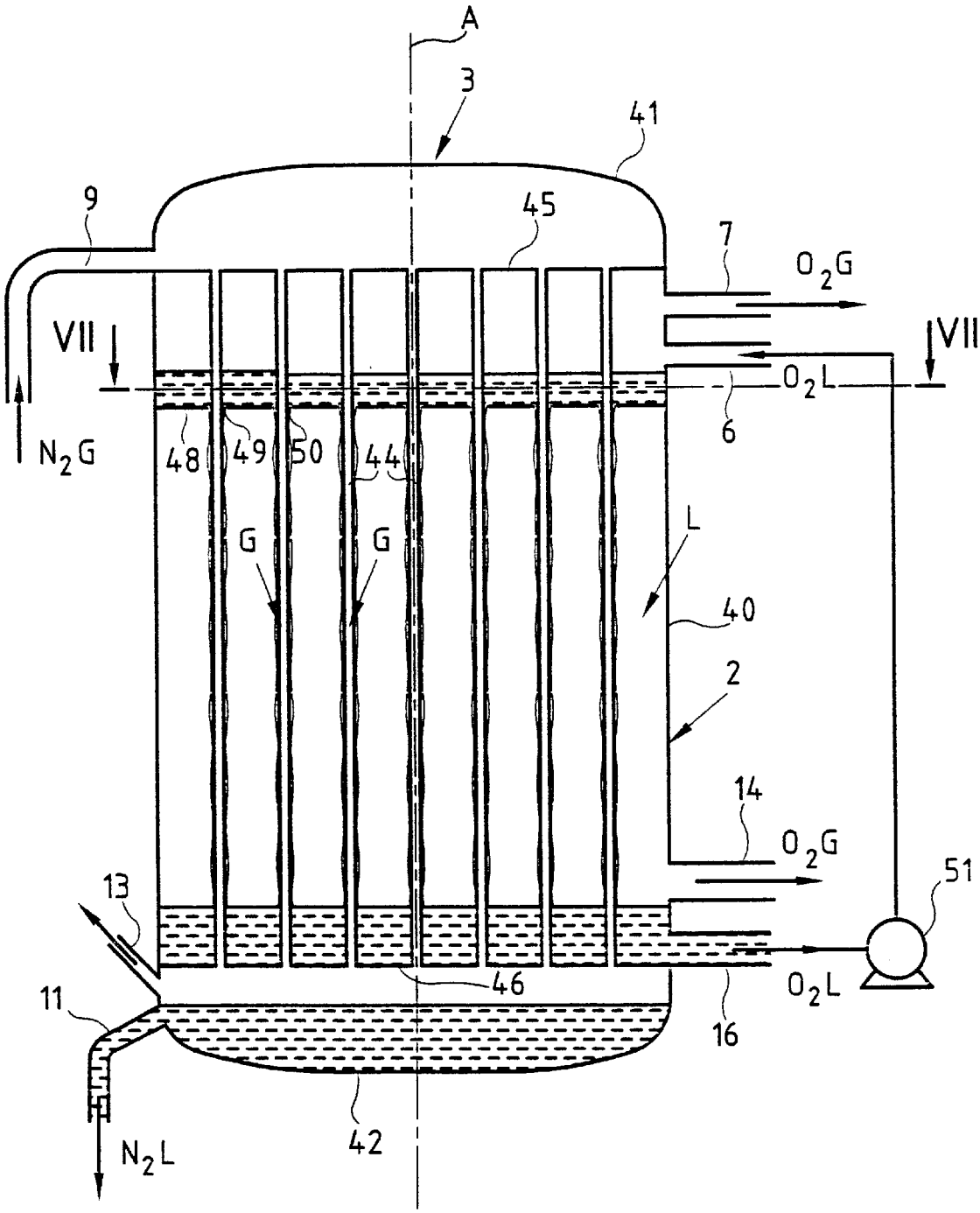
FIG. 6 is a schematic view of a reboiler-condenser according to another embodiment of the invention.

FIG. 6 illustrates another embodiment of the invention, in which the fluidtight vessel 3 of the reboiler-condenser 2 comprises a shell 40 of vertical axis, closed by a convex dome 41 and by a convex bottom 42. A bundle of tubes 44 is placed inside the shell 40, coaxial with the latter, in order to form with the shell 40 a heat exchanger body.

The tubes 44 have an external diameter of approximately 5 mm and a thickness of approximately 1 mm. The tubes 44 are arranged in a regular bundle, which forms, in cross section (FIG. 7), a lattice with a square cell with sides of approximately 8 mm. Preferably, the tubes have an external diameter less than 7 mm and are spaced apart by at least 2 mm.

The upper ends of the tubes 44 are fastened to a so-called upper tube plate 45 into which the tubes open out. The plate 45 is placed in the dome 41. Likewise, the lower ends of the tubes 44 open out in a lower tube plate 46 placed in the bottom 42, the tubes 44 being fastened to this plate 46.

The space bounded by the tube plate 45 and the dome 41 is connected to the pipe 9 for supplying nitrogen-rich gas in order to form means for introducing the gas to be condensed into the tubes 44.

The space bounded by the tube plate 46 and the bottom 42 is connected to the pipe 11 for removing the condensed gas and to the pipe 13 for removing uncondensable rare gases, in order to form means for removing the condensed gas from the tubes 44.

The tubes 44 therefore define, internally, the second passages G.

The pipe 6 for supplying oxygen-rich liquid opens out in the shell 40 beneath the tube plate 45. The return pipe 7 is placed between the tube plate 45 and the pipe 6.

A circular distribution plate 48 is placed beneath the pipe 6 transversely to the axis A of the shell 40. This plate 48 is pierced by a lattice of circular holes 49 having a diameter of 6 mm, each accommodating in a coaxial manner a tube 44.

The pool of the liquid to be vaporized forms above the distribution plate 48. The liquid is distributed beneath this plate 48 by the annular spaces 50 bounded, around the tubes 44, by the holes 49.

The liquid then flows in the form of a liquid running down the external surface of the tubes 44, as a cocurrent with respect to the gas to be condensed.

The vaporized liquid is sent via the pipe 14 into the bottom of the low-pressure column, while the excess liquid oxygen present above the tube plate 46 is sent by the pipe 16 and via a pump 51 into the pipe 6.

The tubes 44 therefore define, on the outside, with the shell 40, a single first passage L dedicated to the circulation of the liquid to be vaporized.

This first passage L possesses, in its free section, an approximately diametral region whose straight director line C, passing through the axis A of the shell 40, has a length of the order of the internal diameter of the shell 40. This internal diameter may, for example, be approximately 1 m. This embodiment of the invention therefore also reduces the risk of the first passage L becoming blocked.

Figure 7:
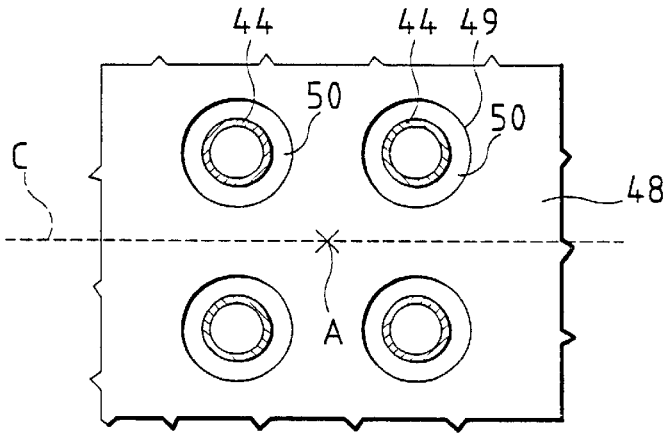
FIG. 7 is a partial, schematic and sectional view taken on the line VII—VII of FIG. 6.

More generally, this effect may be obtained with shapes and dimensions of the base pattern of the bundle of tubes 44 other than those in FIGS. 6 and 7.

In certain cases, the first passage L will comprise, in cross section, a multitude of continuous flow regions, free of any obstacle, which will undulate between the tubes 44. The director curves C of these regions will therefore be sinuous and will have a length preferably greater than approximately 10 cm and, more desirably, greater than approximately 1 m.

What is claimed is:

1. An evaporator, comprising:

a heat exchanger body having main passages placed in a heat-exchanger relationship;

a means for forming a bath of a liquid to be vaporized such that the liquid to be vaporized flows through at least one of a first main passage;

a means for introducing a heating fluid into at least one of a second main passage so as to vaporize the liquid, i) each first and second main passage having at least one continuous free flow region in a section running transverse to a direction of flow of the liquid to be vaporized, the at least one continuous free flow region being sufficiently long to allow the liquid to flow round a deposit of impurities, and ii) each first and second main passage being bound by vertical plates having a substantially similar contour and being parallel to one another and spaced apart so as to form flat main passages having walls, the at least one first main passage being one of a) narrower than the second main passage and containing neither an exchange fin nor an auxiliary passage, and b) containing at least one closed auxiliary passage extending along most of a length of the heat exchanger body parallel to the direction of flow of the liquid to be vaporized, walls of the at least one closed auxiliary passage touching plates defining the at least one first main passage and preventing contact between the liquid to be vaporized and the plates; and means for sending the liquid to be vaporized into the at least one closed auxiliary passage.

2. The evaporator claimed in claim 1, wherein said flow region extends along a director curve having a length greater than approximately 10 cm.

3. The evaporator claimed in claim 2, wherein said director curve has a length greater than or equal to approximately 30 cm.

4. The evaporator claimed in claim 1, wherein said flow region extends approximately over the entire length of the heat exchanger body transverse to the direction of flow of the liquid to be vaporized.

5. The evaporator claimed in claim 1, wherein each first main passage comprises no spacer corrugation between the parallel vertical plates.

6. The evaporator claimed in claim 5, wherein each first main passage is bounded by and lies between two parallel vertical plates, these two parallel vertical plates defining between them a substantially free and continuous space over most of their width transverse to the direction of flow of the liquid to be vaporized.

7. The evaporator claimed in claim 1, wherein the means for forming a bath of the liquid to be vaporized and the means for introducing the heating fluid are arranged so that the heating fluid and the liquid to be vaporized flow as a cocurrent through the heat exchanger body.

8. The evaporator claimed in claim 1, wherein each auxiliary passage prevents the liquid to be vaporized from coming into contact with the vertical plates of the corresponding first main passage.

9. The evaporator claimed in claim 1, wherein each first main passage contains at least one closed auxiliary passage.

10. The evaporator claimed in claim 1, wherein the maximum width of an auxiliary passage is greater than 50% of the distance between two adjacent vertical plates.

11. The evaporator as claimed in claim 1, wherein an internal surface of each auxiliary passage comprises only curved surfaces.

12. The heat evaporator claimed in claim 1, wherein at least one first main passage contains several auxiliary passages comprising a series of cylindrical tubes parallel to each other and each having a diameter at least equal to 50% of a separation between two adjacent plates.

13. The evaporator claimed in claim 1, wherein at least one first main passage contains several auxiliary passages comprising tubes each having an internal surface with at least three identical convexities and curved surfaces connecting the convexities.

14. The evaporator claimed in claim 12, wherein the adjacent tubes are contiguous.

15. The evaporator claimed in claim 12, wherein the adjacent tubes are not contiguous.

16. The evaporator claimed in claim 1, further comprising means for directing the liquid from the bath into each auxiliary passage.

17. The evaporator claimed in claim 16, further comprising means for distributing the liquid from the bath having predistribution openings, said openings allowing the liquid to fall onto a packing lying above the means for directing the liquid into each auxiliary passage.

18. The evaporator claimed in claim 16, wherein the means for directing the liquid into the auxiliary passages are inclined tips, the ends of which tips lie above an inside of the auxiliary passage.

19. The evaporator claimed in claim 1, wherein the auxiliary passages are formed from a block of material placed in the first main passage and having substantially the same dimensions as the first main passage.

20. The evaporator claimed in claim 1, wherein the means for forming a bath of the liquid to be vaporized are means for forming a bath above the first and second main passages, the evaporator furthermore comprising means for introducing the liquid from the bath into each first main passage so that the liquid flows therethrough in the form of a falling film.

21. An air distillation plant comprising an evaporator as claimed in claim 1.

22. The plant claimed in claim 21, wherein the evaporator is a main exchanger which serves to cool purified air to its distillation temperature.

23. The plant claimed in claim 21, wherein the evaporator is a subcooler.

24. The plaint claimed in claim 21, further comprising a first column fed with air and thermally connected to a second column by means of the evaporator.

25. The air distillation plant claimed in claim 24, wherein the first column is a medium-pressure column, the second column is a low-pressure column and the evaporator is a reboiler-condenser for bringing oxygen in a bottom of the low-pressure column and nitrogen from a top of the medium-pressure column into a heat-exchange relationship.

26. An evaporator, comprising:

a heat exchanger body having first and main passages placed in a heat-exchanger relationship;

a means for forming a bath of a liquid to be vaporized such that the liquid to be vaporized flows through at least one of the first main passage;

a means for introducing a heating fluid into at least one of the second main passage so as to vaporize the liquid, i) each first and second main passage having at least one continuous free flow region in a section running transverse to a direction of flow of the liquid to be vaporized, the at least one continuous free flow region being sufficiently long to allow the liquid to flow round a deposit of impurities, and ii) each first and second main passage being bound by vertical plates having a substantially similar contour and being parallel to one another and spaced apart so as to form flat main passages having walls, the at least one first main passage containing at least one closed auxiliary passage extending along most of a length of the heat exchanger body parallel to the direction of flow of the liquid to be vaporized, walls of the at least one closed auxiliary passage touching plates defining the at least one first main passage and preventing contact between the liquid to be vaporized and the plates; and means for sending the liquid to be vaporized into the at least one closed auxiliary passage.

* * * * *